US008529015B2

(12) United States Patent
Williams et al.

(10) Patent No.: US 8,529,015 B2
(45) Date of Patent: Sep. 10, 2013

(54) APPARATUS AND METHOD FOR REMOVAL OF INK FROM AN EXTERIOR OF A PRINTHEAD

(75) Inventors: James Edward Williams, Penfield, NY (US); Roger G. Leighton, Hilton, NY (US); Paul A. Hosier, Rochester, NY (US); David Peter Lomenzo, Pittsford, NY (US); David Kenneth Ahl, Rochester, NY (US); Scott J. Phillips, West Henrietta, NY (US); John R. Uchal, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/364,618

(22) Filed: Feb. 2, 2012

(65) Prior Publication Data

US 2013/0201254 A1 Aug. 8, 2013

(51) Int. Cl.
*B41J 2/165* (2006.01)

(52) U.S. Cl.
USPC ..... 347/25

(58) Field of Classification Search
None
See application file for complete search history.

(56) References Cited

U.S. PATENT DOCUMENTS

| | | | | |
|---|---|---|---|---|
| 4,623,897 | A | 11/1986 | Brown et al. | |
| 4,928,114 | A | 5/1990 | Fagerquist et al. | |
| 4,970,535 | A * | 11/1990 | Oswald et al. | 347/25 |
| 5,184,147 | A * | 2/1993 | MacLane et al. | 347/30 |
| 5,557,306 | A | 9/1996 | Fukushima et al. | |
| 6,463,674 | B1 | 10/2002 | Meyers et al. | |
| 6,890,053 | B2 | 5/2005 | Myhill et al. | |
| 7,419,239 | B2 * | 9/2008 | Brown et al. | 347/25 |
| 7,455,387 | B2 | 11/2008 | Cunnington et al. | |
| 7,751,767 | B2 | 7/2010 | Burton et al. | |
| 7,871,556 | B2 * | 1/2011 | Patel et al. | 264/401 |
| 7,901,035 | B2 | 3/2011 | Koehler et al. | |
| 7,918,530 | B2 | 4/2011 | Kanfoush et al. | |
| 8,070,277 | B2 | 12/2011 | Phillips et al. | |
| 2001/0012027 | A1 | 8/2001 | Murcia et al. | |
| 2007/0076048 | A1 | 4/2007 | Cunnington et al. | |
| 2008/0063441 | A1 | 3/2008 | Burton et al. | |
| 2009/0102906 | A1 | 4/2009 | Phillips et al. | |
| 2010/0220145 | A1 | 9/2010 | Koehler et al. | |
| 2010/0238227 | A1 | 9/2010 | Nystrom et al. | |
| 2011/0157278 | A1 | 6/2011 | Gulvin et al. | |
| 2011/0261110 | A1 | 10/2011 | Lu et al. | |
| 2011/0304674 | A1 | 12/2011 | Sambhy et al. | |

* cited by examiner

*Primary Examiner* — Matthew Luu
*Assistant Examiner* — Michael Konczal
(74) *Attorney, Agent, or Firm* — Maginot, Moore & Beck, LLP

(57) ABSTRACT

In an inkjet printing apparatus, a heater heats a drip bib that is located below a plurality of inkjets in a printhead to a temperature that melts ink collected on a surface of the drip bib. Pressurized air is directed toward the surface of the drip bib to remove the melted ink from the surface of the drip bib.

18 Claims, 5 Drawing Sheets

APPARATUS AND METHOD FOR REMOVAL OF INK FROM AN EXTERIOR OF A PRINTHEAD

TECHNICAL FIELD

This disclosure relates generally to imaging devices that eject ink to form images on print media, and, more particularly, to devices that clean ink from printheads in such printers.

BACKGROUND

In general, inkjet printing machines or printers include at least one printhead that ejects drops or jets of liquid ink onto recording media or onto an image receiving member surface. A phase-change inkjet printer employs phase-change inks that are in the solid phase at ambient temperature, but transition to a liquid phase at an elevated temperature. A mounted printhead ejects drops of the molten ink to form an ink image. The ink can be ejected directly onto print media or onto an image receiving member surface, such as a rotating drum or moving belt, before the image is transferred to print media. Once the ejected ink is transferred to the print medium the ink droplets quickly solidify to form an image.

The media used in both direct and offset printers are typically provided in sheet or web form. A media sheet printer typically includes a supply drawer that houses a stack of media sheets. A feeder removes a sheet of media from the supply and directs the sheet along a feed path past a printhead so the printhead ejects ink directly onto the sheet. In offset sheet printers, a media sheet travels along the feed path to a nip formed between the rotating imaging member and a transfix roller. The pressure and heat in the nip transfer the ink image from the imaging member to the media. In a web printer, a continuous supply of media, typically provided in a media roll, is entrained onto rollers that are driven by motors. The motors and rollers pull the web from the supply roll through the printer to a take-up roll. As the media web passes through a print zone opposite the printhead or heads of the printer, the printheads eject ink onto the web. Along the feed path, tension bars or other rollers remove slack from the web so the web remains taut without breaking.

Printers can conduct various maintenance operations to ensure that the ink ejectors in each printhead operate efficiently. A cleaning operation is one such maintenance operation. The cleaning process removes particles or other contaminants that interfere with printing operations from the printhead, and unclogs solidified ink or contaminants from inkjet ejectors. During a cleaning operation, the printheads purge ink through some or all of the ink ejectors in the printhead. The purged ink flows through the ejectors and down the front face of the printheads, where the ink drips into an ink receptacle. To control the flow of ink down the face of each printhead, some printhead assemblies include a drip bib positioned below each printhead. The drip bib has a shape that directs liquid ink toward the ink receptacle. The lower edge of the drip bib tapers to one or more channels or points where ink collects prior to dripping into the receptacle. In some printers, a wiper engages the front face of the printhead and wipes excess purged ink in a downward direction toward the drip bib to remove excess purged ink.

While existing cleaning processes are useful to maintain printheads, removing residual purged ink from the drip bib presents a challenge. Due to surface tension, a small portion of the purged ink that flows down the drip bib remains in contact with the drip bib after the cleaning process. Existing drip bibs include a coating of a low surface energy material, such as polytetrafluoroethylene, to reduce the adhesion between the ink and the drip bib, but small amounts of ink remain on the drip bib after the cleaning process is completed. In inkjet printers using a phase-change ink, this residual ink may cool and solidify while on the drip bib. Occasionally, the solidified ink breaks free from the drip bib and interferes with imaging operations. When the solidified ink separates from the drip bib, the ink may contact the web as the web moves past printheads in the print zone. The solidified ink may negatively affect image quality on the web, and the web may carry the solidified ink past one or more printheads in the print zone. Since printheads are often positioned a short distance from the web, the carried ink may contact the face of one or more printheads with adverse consequences. Thus, improved printhead cleaning is desirable.

SUMMARY

In one embodiment, a method for cleaning ink from a printhead in a printer has been developed. The method includes activating a heater to heat a drip bib positioned below a plurality of inkjets in the printhead to a first temperature that enables phase-change ink on a surface of the drip bib to melt, and emitting pressurized air toward the surface of the drip bib from a pressurized air source to remove the melted phase-change ink from the surface of the drip bib.

In another embodiment, an inkjet printing apparatus has been developed. The apparatus includes a printhead including a plurality of inkjets arranged in a face of the printhead and a drip bib positioned below the face of the printhead, a heater operatively connected to the printhead, a pressurized air source configured to emit pressurized air, and a controller operatively connected to the heater and the pressurized air source. The controller is configured to activate the heater to heat the drip bib to a first temperature to enable phase-change ink on a surface of the drip bib to melt, and activate the pressurized air source to emit the pressurized air toward the surface of the drip bib to remove the melted phase-change ink from the surface of the drip bib.

DETAILED DESCRIPTION

Figure 1:
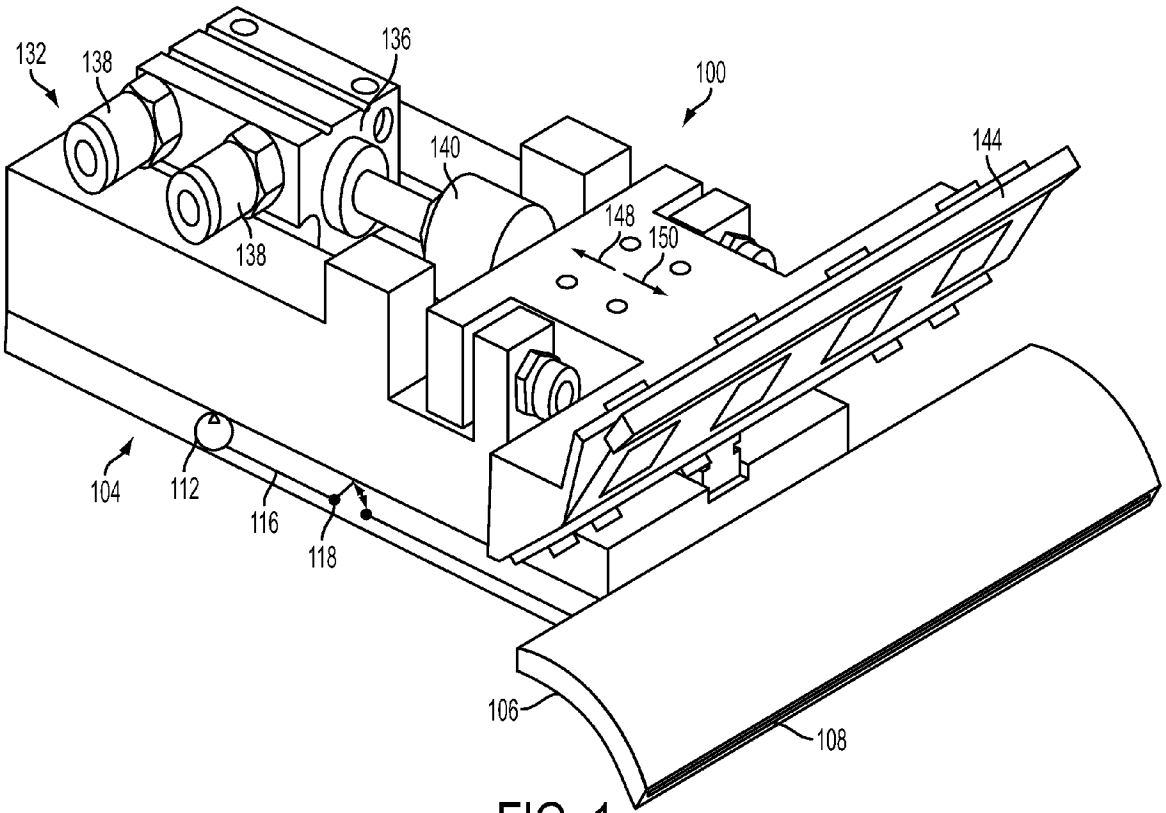
FIG. 1 is a perspective view of a printhead maintenance unit that includes a pressurized air outlet.

For a general understanding of the environment for the system and method disclosed herein as well as the details for the system and method, reference is made to the drawings. In the drawings, like reference numerals have been used throughout to designate like elements. As used herein the term "printer" refers to any device that is configured to form ink images on media and includes photocopiers, facsimile machines, multifunction devices, as well as direct and indirect inkjet printers. An image receiving surface refers to any surface that receives ink drops, such as an imaging drum, imaging belt, or various print media including paper.

Figure 5:
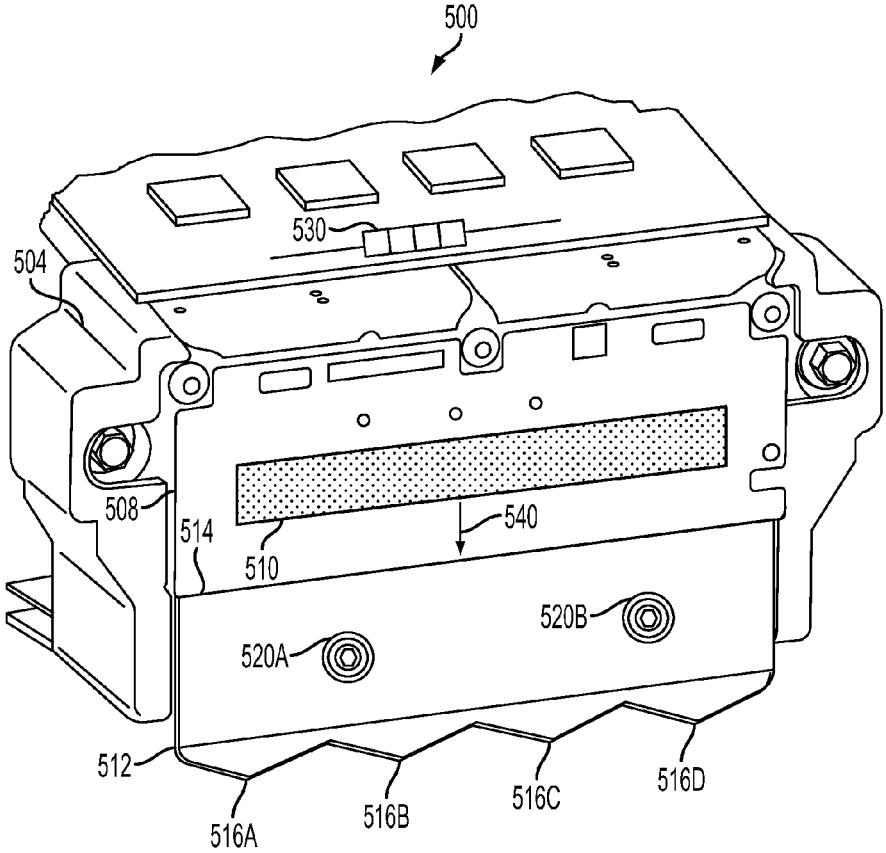
FIG. 5 PRIOR ART
FIG. 5 is a perspective view of a prior art printhead that includes a drip bib.

FIG. 5 depicts a prior art printhead 500. The printhead 500 includes a printhead housing 504, a printhead face 508, and a drip bib 512. The printhead housing 504 includes an ink manifold that supplies liquefied ink to an array of inkjets. Each inkjet ejects ink drops through an aperture, or nozzle, and the printhead 500 includes an array of inkjet nozzles 510 formed in a two-dimensional arrangement in a printhead face 508. During an imaging operation, the inkjets eject drops of ink through the nozzles 510 and onto an image receiving surface, such as a media web or sheet of paper, or onto an indirect image receiving member, such as an imaging drum or belt.

The printhead 500 includes a heater 530, depicted schematically in FIG. 5, which generates heat to melt phase-change ink in the printhead for printing and purging operations. The heater 530 heats both the printhead 500, including internal ink manifolds, the printhead face 508, inkjets 510, and the drip bib 512. In the embodiment of FIG. 5, the heater 530 is an electrical heater that can include one or more heating elements positioned in the printhead 500.

The drip bib 512 is positioned below the printhead face 508 with a top edge 514 of the drip bib abutting the bottom of the printhead face 508. Fasteners 520A and 520B secure the drip bib 512 to the printhead 500. In the embodiment of FIG. 5, the fasteners 520A and 520B are bolts that pass through the drip bib 512 and engage threaded holes (not shown) formed in the printhead 500. The bottom edge of the drip bib 512 is formed with a plurality of downward pointed tips 516A-516D. Ink flows toward the downward pointed tips 516A-516D and drips from the drip bib into an ink collection receptacle. Alternative drip bib embodiments have different configurations of the lower edge including flat lower edges that converge to a different number of tips and drip bibs that include fluid channels to direct liquid ink to one or more outlets along the lower edge of the drip bib. In the embodiment of FIG. 5, polytetrafluoroethylene or another low surface energy material that resists adhesion between the purged ink and the surface of the drip bib coasts the drip bib 512.

During a printhead maintenance operation in the printhead 500, air pressure applied to the ink manifold in the housing 504 purges ink through the inkjet nozzles 510 in a stream instead of as individual drops. The purged ink flows down the printhead face in direction 540 and onto the surface of the drip bib 512. The majority of the purged ink flows toward the downward pointed tips 516A-516D and subsequently leaves the drip bib 512. Some of the purged ink, however, remains in contact with the drip bib 512 as residual ink on the face of the drip bib 512, near the downward pointed tips 516A-516D, and on the fasteners 520A-520B. As described in more detail below, a printhead maintenance system using pressurized air removes the residual ink from the drip bib 512 during the printhead maintenance process.

FIG. 1 depicts a printhead maintenance unit 100 that includes a pressurized air emitter 104 and a wiper assembly 132. The pressurized air emitter 104 includes an outlet housing 106 that forms an outlet 108, a pressurized air source 112, air conduit 116, and valve 118. The outlet housing 106 is located below the wiper assembler 132 and is formed with a downward curved shape to orient the outlet 108 at a downward angle with respect to a printhead. As depicted in more detail below, the outlet housing 106 and outlet 108 direct pressurized air toward a drip bib that is positioned below an array of inkjet nozzles formed in a face of a printhead. The outlet housing 106 and outlet 108 direct pressurized air onto the drip bib and away from inkjets in the printhead to avoid formation of air bubbles within the printhead due to a flow of pressurized air through the inkjet nozzles. Additionally, the downward angle of the pressurized air outlet 108 urges ink formed on the surface of the drip bib into an ink receptacle for collection during the maintenance process. The outlet housing 106 and outlet 108 have a width that corresponds to a width of a drip bib. The elongated configuration of the outlet 108 emits pressurized air in a linear configuration across the width of the drip bib. The pressurized air emitter 104 is alternatively referred to as an "air knife" since the outlet 108 emits the pressurized air in a linear area that is similar to the edge of a knife.

In the embodiment of FIG. 1, printhead maintenance unit 100 houses the pressurized air source 112, which is depicted schematically as an electrically powered air compressor. The pressurized air source 112 generates pressurized air and directs the pressurized air through an air conduit 116 to the outlet 108. In other embodiments, the pressurized air source 112 is housed externally from the printhead maintenance unit 100 and is coupled to the outlet 108 through air hoses or another air conduit. In some embodiments, one air compressor supplies pressurized air to a plurality of printhead maintenance units for maintenance operations on a plurality of printheads in a printer. In the pressurized air emitter 104, the pressurized air source 112 generates an air pressure through the outlet 108 of approximately sixty pounds per square inch (PSI). Alternative pressurized air emitter embodiments generate greater or lesser air pressure outputs.

In the printhead maintenance unit 100, the wiper assembler 132 includes an actuator 136, piston 140, and a wiper blade 144. The actuator 136 is mechanically coupled to the wiper blade 144 via the piston 140. In wiper assembly 132, the actuator 136 is a pneumatic actuator driven by pressurized air delivered through couplings 138. In another embodiment, the actuator is a hydraulic actuator driven by a hydraulic fluid delivered through hydraulic couplings similar to the couplings 138. In still another embodiment, the actuator is an electric motor that is driven by an electrical current. The wiper blade 144 is oriented with an upward angle to engage the printhead face 508 at a location above the inkjet nozzles 510. The wiper blade 144 has a width that corresponds to the width of the printhead face 508. As depicted below, a positioning system moves the printhead maintenance unit 100 and the wiper blade 144 into engagement with the printhead 500 at various locations on the printhead face 508. The wiper blade 144 includes a rubberized tip that conforms to the surface of the printhead face 508 and pushes ink on the surface of the printhead face 508 downward onto the drip bib 512.

Figure 2:
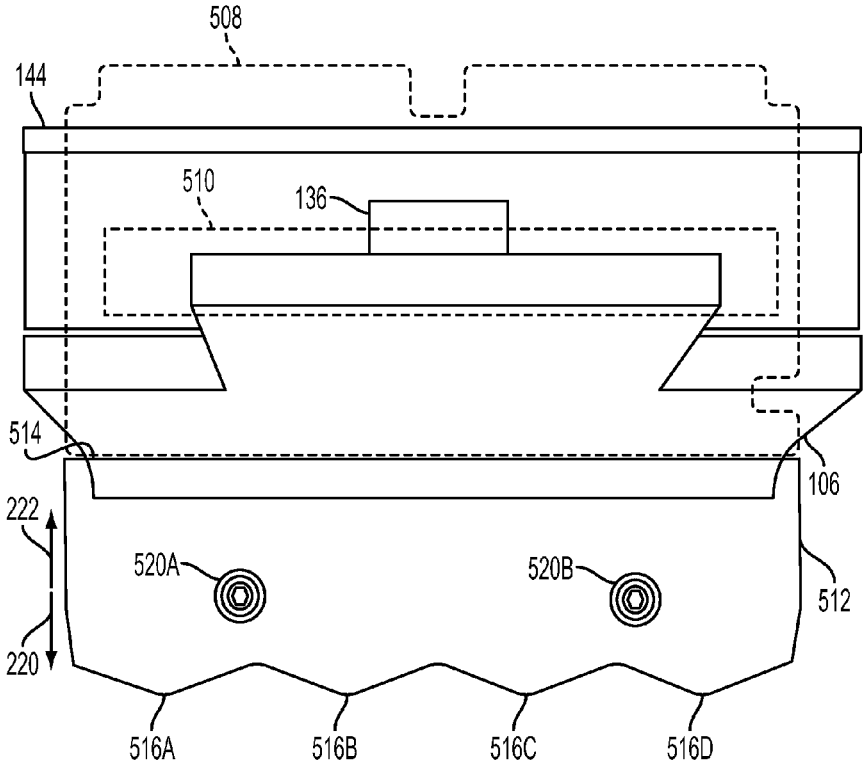
FIG. 2 is a front view of the printhead maintenance unit of FIG. 1 with the pressurized air outlet positioned to direct pressurized air toward a drip bib in a printhead.

With reference to FIG. 1 and FIG. 2, during a printhead maintenance operation, the actuator 136 moves the wiper blade 144 in direction 150 to a first position where the wiper blade 144 extends past the outlet 108 in the pressurized air emitter 104. The wiper blade 144 engages the face of a printhead, such as printhead face 508, and wipes ink on the printhead face 508 downward in direction 220 toward the drip bib 512, while the outlet housing 106 remains at a predetermined distance from the printhead 500. The actuator 136 retracts the wiper blade 144 in direction 148 to enable the maintenance unit 100 to move up and down the height of the printhead 500 in directions 222 and 220, respectively, while the wiper 144 does not engage the printhead 500. The pressurized air emitter 104 is configured to generate pressurized air that is directed onto the drip bib 512 both when the wiper 144 engages the printhead face 508 and when the wiper 144 is disengaged from the printhead face 508. As depicted in FIG. 2, the outlet housing 106 moves to a position proximate to the top edge 514 of the drip bib 512 and the pressurized air emitter 104 directs pressurized air onto the drip bib 512 and away from the inkjet nozzles 510. This air stream urges residual ink on the drip bib 512 toward the downward pointed tips 516A-516D on the lower edge of the drip bib 512.

Figure 3:
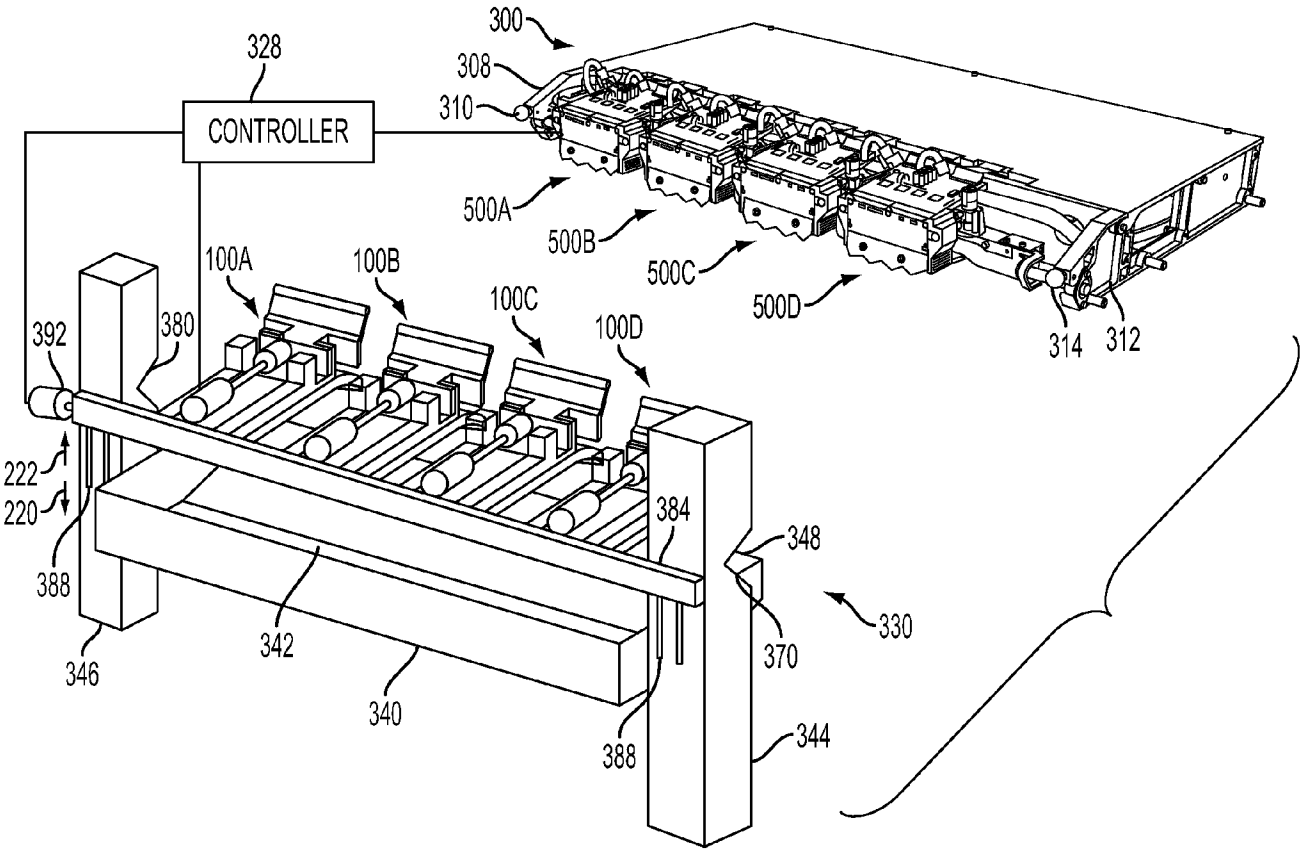
FIG. 3 is a perspective view of a printhead array and array of printhead maintenance units.

In a printer embodiment that includes a plurality of printheads, a printhead maintenance system includes a corresponding plurality of printhead maintenance units that engage the multiple printheads during a maintenance operation. FIG. 3 depicts an exemplary arrangement of printheads 500A-500D in a printhead array 300 and an arrangement of printhead maintenance units 100A-100D arranged in a printhead array maintenance unit 330. In FIG. 3, each of the printheads 500A-500D has substantially the same configuration as printhead 500, and each of the printhead maintenance units 100A-100D has substantially the same configuration as the printhead maintenance unit 100.

The printhead array 300 houses the printhead 500A-500D and further includes docking balls 310 and 314 that are connected to carriage support members 308 and 312, respectively. The docking balls 310 and 314 are configured to engage docking members 370 and 380, respectively, in the printhead array maintenance unit 330. The carriage members 308 and 312 hold the printhead array 300 in a fixed position in engagement with the printhead array maintenance unit 330 during a maintenance operation. The printhead array 300 moves into engagement with the printhead array maintenance unit 330 during a maintenance operation, and moves out of engagement from the printhead array maintenance unit 330 during printing operations.

Some printer embodiments include a plurality of printhead arrays similar to the printhead array 300. Alternative printhead arrays include a greater or lesser number of printheads, and a single printer can include printhead arrays with different numbers of printheads. For example, a printer that includes the printhead array 300 can also include alternating printhead arrays that include three printheads arranged in a staggered configuration with the printheads 500A-500D depicted in FIG. 3.

The printhead array maintenance unit 330 houses the printhead maintenance units 100A-100D and further includes support members 344 and 346, a moveable beam 384, actuator 392, and an ink receptacle 340. The support members 344 and 346 provide support for the moveable beam 384 and printhead maintenance units 100A-100D and for the ink receptacle 340. As described above, the docking members 370 and 380 formed in support members 344 and 346, respectively, enable the printhead array 300 to engage the printhead array maintenance unit 330 during maintenance operations. Once docked with the printhead array maintenance unit 330, the drip bib 512 in each of the printheads 500A-500D is located at a predetermined distance from the pressurized air outlet 108 in each of the printhead maintenance units 100A-100D, respectively. In the embodiment of FIG. 3, a distance of approximately one centimeter separates the pressurized air outlet from each drip bib 512.

The ink receptacle 340 houses an ink collection reservoir 342 that collects purged ink from the printheads 500A-500D. During a printhead maintenance operation, the printheads 500A-500D move past a front wall 348 of the ink receptacle 340 to position the drip bib 512 in each of the printheads 500A-500D over the ink collection reservoir 342. Purged ink from the printheads 500A-500D enters the ink collection reservoir 342. The ink collection reservoir 342 also captures ink that is removed from the drip bib 512 by the pressurized air emitters 104 in each of the printhead maintenance units 100A-100D.

The printhead array maintenance unit 330 includes a positioning system that has an electrical actuator 392, moveable beam 384, and tracks 388 formed in each of the support members 344 and 346. The moveable beam 384 moves up and down in directions 222 and 220, respectively, along the tracks 388 in response to the operation of the electrical actuator 392. The moveable beam 384 is fixedly engaged to the printhead maintenance units 100A-100D. Consequently, the wiper blade 144 and pressurized air outlet 108 in each of the printhead maintenance units moves up and down in directions 222 and 220, respectively, with the moveable beam 384. During a printhead maintenance operation, the actuator 392 moves each of the printhead maintenance units 100A-100D with reference to printheads 500A-500D, respectively.

Operation and control of the printhead array 300, printhead array maintenance unit 330, and optionally other components and functions of an inkjet printer are performed with the aid of a controller 328. The controller 328 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions, such as the difference minimization function, described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 4:
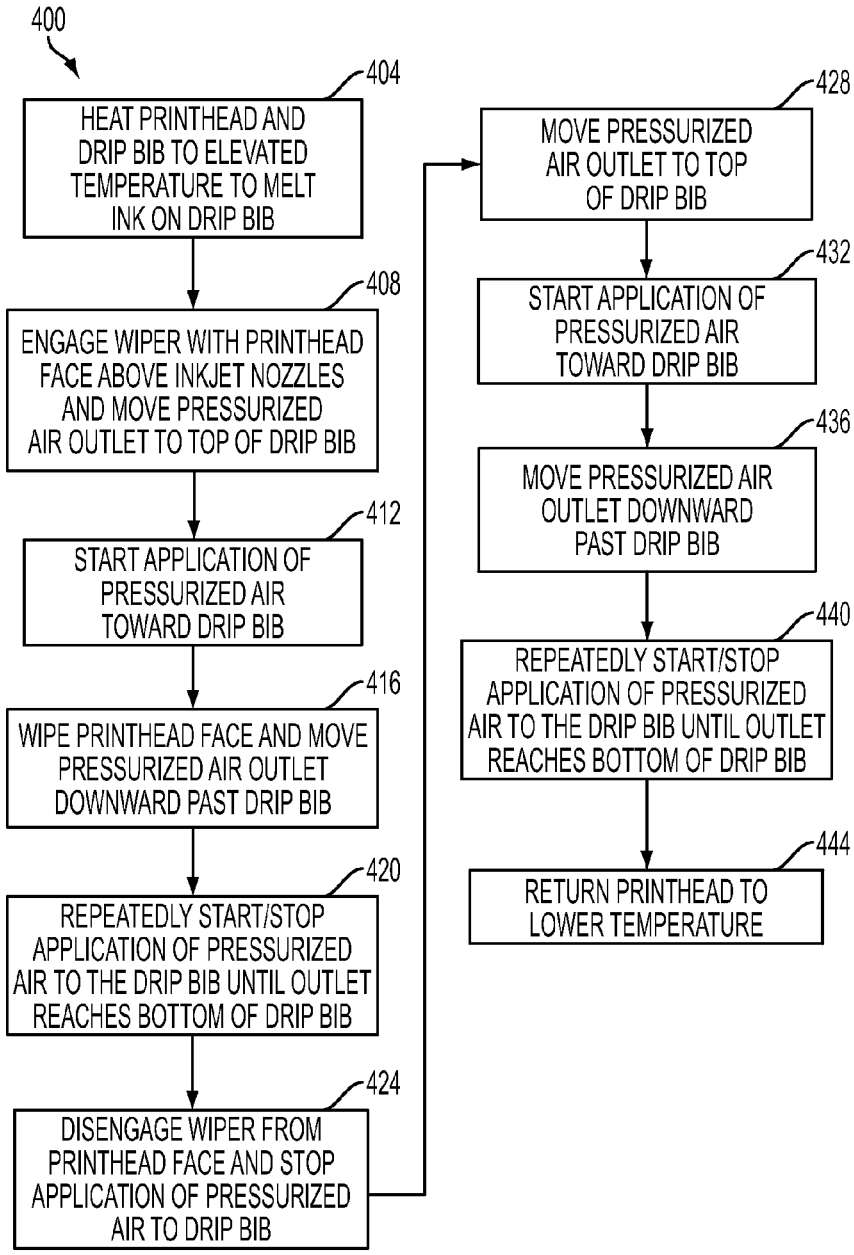
FIG. 4 is a block diagram of a process for removing ink from an exterior of a printhead.

FIG. 4 depicts a printhead maintenance process 400. As used in this document, a reference to a process performing or doing some function or event refers to a controller configured with programmed instructions and electronic components operatively connected to the controller performing the function or event by executing the instructions and/or operating one or more components. Process 400 is described with reference to the printhead array 300, printhead array maintenance unit 330, and controller 328 of FIG. 3 for illustrative purposes.

Process 400 begins by activating the heater 530 in each of the printheads 500A-500D (block 404). The heater 530 elevates the temperature of the face 508 and the drip bib 512 in each printhead to a temperature that is above the melting point of the ink formed on the exterior of each printhead. In some embodiments, the elevated temperature is greater than a temperature of the ink that enables the ink to melt for use in printing operations. For example, a phase-change ink is heated to a temperatures of approximately 115° C. during a printing operation. The phase-change ink melts at 115° C. and inkjets in the printhead 500 eject drops of the melted ink through the inkjet nozzles 510. Process 400 heats the printhead 500 and ink on the printhead face 508 and 512 to a higher temperature than the temperature used for printing operations. In one embodiment, the heater 530 elevates the temperature of the printhead 500 to approximately 130° C. The increased temperature of the printhead 500 enables the phase-change ink to remain in a liquid state as pressurized air is directed onto the drip bib 512.

In some embodiments, the pressurized air has a temperature that is below the elevated temperature of the printhead 500. The elevated temperature of the printhead 500 enables the ink to remain liquefied even if the lower-temperature pressurized air reduces the temperature of the printhead 500. As is known in the art, the pressurized air expands and cools after leaving the outlet 108 in the pressurized air emitter 104. In the example of printhead 500, the temperature range of the pressurized air as the pressurized air contacts the drip bib 512 is between approximately 15° C. and 115° C. to clean liquid ink from the drip bib 512. Alternative embodiments can operate with higher or lower pressurized air temperatures based on various factors including the melting and boiling points of the phase-change ink, level of applied air pressure, temperature of the drip bib, and thermal mass of the drip bib and printhead.

In other embodiments, the pressurized air is heated prior to being applied to the drip bib 512. In embodiments that employ heated pressurized air, the printhead heater 530 can heat the printhead 500 to the temperature used for printing operations, or does not heat the printhead 500 when the heated pressurized air melts the phase-change ink on the drip bib 512.

As part of a printhead maintenance operation, process 400 engages the wiper in each printhead maintenance unit 100 with the printhead face 508 at a location above the inkjet nozzles 510, and moves the outlet 108 of the pressurized air emitter 104 to a position proximate the top edge 514 of the drip bib 512 (block 408). FIG. 2 depict the position of the printhead maintenance unit 100 engaged to the printhead 500. In the wiper assembly 132, the actuator 136 moves the wiper blade 144 in direction 150 to engage the wiper blade 144 with the printhead face 508.

Once the wiper blade 144 engages the printhead face 508, the pressurized air emitter 104 begins application of pressurized air onto the drip bib 512 (block 412). In one embodiment, the pressurized air source 112 activates and the pressurized air is directed toward the drip bib 512 through the outlet 108. In another embodiment, the pressurized air source is already activated and the valve 118 opens to enable pressurized air to flow through the conduit 116 and the outlet 108.

Process 400 continues as the printhead maintenance unit 100 moves downward to wipe the printhead face 508 and apply pressurized air to the drip bib 512 (block 416). The controller 328 operates the actuator 392 and the moveable beam 384 and printhead maintenance units 100A-100D move in direction 220. The wiper 144 pushes drops of liquid ink on the printhead face 508 toward the drip bib 512 to clean the printhead face 508. In one embodiment, the actuator 392 moves each of the printhead maintenance units 100 at a velocity of approximately 0.5 millimeters/second.

In process 400, the controller 328 repeatedly starts and stops the application of pressurized air from the pressurized air emitter 104 onto the drip bib 512 as the printhead maintenance unit 100 moves downward with respect to the printhead 500 (block 420). In one configuration, the controller 328 repeatedly activates and deactivates the pressurized air source 112 to start and stop the application of pressurized air to the drip bib 512. In another embodiment, the pressurized air source 112 remains activated and the controller 328 opens and closes the valve 118 to start and stop the application of pressurized air to the drip bib 512. The controller 328 repeatedly starts and stops the application of pressurized air toward the drip bib 512 in a predetermined sequence, such as starting and stopping the pressurized air at intervals of approximately one second. That is to say, the printhead maintenance unit 100 starts the application of pressurized air for one second, then stops the application for one second, and continues to start or stop the application of pressurized air each second as the outlet 108 moves down the drip bib 512. The repeated starting and stopping of the pressurized air toward the drip bib 512 reduces the magnitude of a drop in temperature in the drip bib 512 that is produced by the application of pressurized air at a lower temperature than the elevated temperature of the printhead 500. Thus, the phase-change ink on the drip bib 512 remains in a liquid phase as the printhead maintenance unit applies pressurized air to the drip bib 512. An alternative embodiment applies the pressurized air to the drip bib 512 continuously until the printhead maintenance unit 100 has completed the wiping process.

As describe above, the pressurized air emitter 104 can emit pressurized air over a wide range of temperatures. The overall proportion of time that the pressurized air source applies air to the drip bib in process 400 can be proportional to the pressurized air temperature. For lower pressurized air temperatures, such as temperatures near 15° C., the pressurized air emitter 104 stops the application of pressurized air for comparatively longer periods so that the pressurized air does not cool and solidify ink on the drip bib 512. For higher pressurized air temperatures, such as temperatures near 115° C., the pressurized air emitter 104 can operate for longer periods or operate continuously since the ink remains above the melting temperature on the drip bib 512.

Once the wiper blade 144 has reached the bottom of the printhead face 508 and the pressurized air emitter 104 has reached the bottom of the drip bib 512, the wiper 144 is disengaged from the printhead face 508 and the pressurized air emitter stops application of the pressurized air toward the drip bib 512 (block 424). In each of the printhead maintenance units 100A-100D, the controller 328 operates the actuator 136 to withdraw the wiper 144 from a corresponding printhead 500A-500D in direction 148.

Process 400 continues by moving the pressurized air outlet 108 in the printhead maintenance assembly to a location proximate the top edge 514 of the drip bib 512 (block 428). The controller 328 operates the actuator 292 to and moveable support 384 to move the printhead maintenance units 100A-100D in direction 222 to return of the printhead maintenance units 100A-100D is in the position depicted in FIG. 2. Since the wiper 144 in each of the printhead maintenance units 100A-100D is retracted, the printhead maintenance units 100A-100D do not contact the printheads 500A-500D while moving in direction 222.

Process 400 moves the pressurized air emitter 104 down the drip bib 512 in a second pass by starting application of the pressurized air toward the drip bib (block 432), moving the pressurized air outlet 108 downward past the drip bib 512 (block 436), and repeatedly starting and stopping the application of pressurized air. The starting and stopping of the pressurized air application continues until the outlet 108 reaches the bottom of the drip bib 512 (block 440). With the exception that the wiper 144 is disengaged from the printhead face 508, process 400 performs the processing described in blocks 432-440 in substantially the same manner as described above with reference to the processing described in blocks 412-420, respectively. The second application of pressurized air onto the drip bib 512 removes additional ink that the wiper 144 deposits on the drip bib 512.

Process 400 concludes by returning the printheads 500A-500D to a lower operating temperature (block 444). In the printhead array 300, the controller 328 adjusts the level of heat emitted by the heater 530 in each of the printheads 500A-500D. In one configuration, the controller 328 maintains the printheads 500A-500D at an elevated operating temperature that is below the printhead temperature of the printheads during the maintenance process.

In one alternative embodiment, process 400 omits the wiping of the printhead face 508 as described in process blocks 408-424 above. Instead, the printhead 500 is heated to the elevated temperature and the pressurized air source applies pressurized air to the drip bib to remove residual ink from the drip bib after the completion of a printhead maintenance process that is known to the art. The elevated temperature of the drip bib and the directed application of pressurized air onto the drip bib remove the residual phase-change ink from the drip bib, whereas previously known maintenance processes leave the ink on the drip bib.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed:

1. A method of cleaning ink from a printhead in a printer comprising:

activating a heater to heat a drip bib positioned below a plurality of inkjets in the printhead to a first temperature that enables phase-change ink on a surface of the drip bib to melt; and positioning an outlet of a pressurized air source at a first location proximate to a top of the drip bib;

emitting pressurized air from the pressurized air source through the outlet toward the surface of the drip bib while moving the outlet from the first location to a second location that is proximate to a bottom of the drip bib to remove the melted phase-change ink from the surface of the drip bib.

2. The method of claim 1 further comprising:

starting and stopping the emission of the pressurized air through the outlet of the pressurized air source while moving the outlet from the first location to the second location.

3. The method of claim 2, wherein the emission of the pressurized air through the outlet starts and stops repeatedly while moving the outlet from the first location to the second location.

4. The method of claim 3, wherein the pressurized air source starts the emission of the pressurized air through the outlet for approximately one second and stops the emission of the pressurized air through the outlet for approximately one second in a repeated manner while moving the outlet from the first location to the second location.

5. The method of claim 1, wherein the pressurized air source emits the pressurized air with a temperature that is below the first temperature.

6. The method of claim 1, the first temperature being greater than a second temperature that melts phase-change ink in the printhead for ejection through the plurality of inkjets.

7. The method of claim 6, the first temperature being approximately 130° C. and the second temperature being approximately 115° C.

8. The method of claim 1, the emitting of the pressurized air from the pressurized air source further comprising:

emitting the pressurized air through the outlet of the pressurized air source to direct the pressurized air toward the surface of the drip bib and away from the plurality of inkjets in the printhead.

9. The method of claim 8, wherein the outlet of the pressurized air source is oriented to emit the pressurized air in a downward direction toward the surface of the drip bib.

10. An inkjet printing apparatus comprising:

a printhead including a plurality of inkjets arranged in a face of the printhead and a drip bib positioned below the face of the printhead;

a heater operatively connected to the printhead;

a pressurized air source configured to emit pressurized air;

a positioning system configured to move an outlet of the pressurized air source from a first location proximate a top of the drip bib to a second location proximate a bottom of the drip bib; and a controller operatively connected to the heater, the positioning system and the pressurized air source, the controller being configured to:

activate the heater to heat the drip bib to a first temperature to enable phase-change ink on a surface of the drip bib to melt; and activate the pressurized air source to emit the pressurized air through the outlet while operating the positioning system to move the outlet from the first location to the second location toward the surface of the drip bib to remove the melted phase-change ink from the surface of the drip bib.

11. The inkjet printing apparatus of claim 10, the controller being further configured to:

activate and deactivate the emission of the pressurized air from the pressurized air source through the outlet while the positioning system moves the outlet from the first location to the second location.

12. The inkjet printing apparatus of claim 11, the controller being further configured to:

repeatedly activate and deactivate the pressurized air source while the positioning system moves the outlet from the first location to the second location.

13. The inkjet printing apparatus of claim 12, the controller being further configured to:

activate the pressurized air source for approximately one second and deactivate the pressurized air source for approximately one second in a repeated manner while the positioning system moves the outlet from the first location to the second location.

14. The inkjet printing apparatus of claim 10, wherein the pressurized air source is configured to emit the pressurized air with a temperature that is less than the first temperature.

15. The inkjet printing apparatus of claim 10, the first temperature being greater than a second temperature that melts phase-change ink in the printhead for ejection through the plurality of inkjets.

16. The inkjet printing apparatus of claim 10, the first temperature being approximately 130° C. and the second temperature being approximately 115° C.

17. The inkjet printing apparatus of claim 10, the pressurized air source further comprising:

an outlet configured to direct the pressurized air toward the surface of the drip bib and away from the plurality of inkjets in the printhead.

18. The inkjet printing apparatus of claim 17, wherein the outlet of the pressurized air source is oriented to emit the pressurized air in a downward direction toward the surface of the drip bib.

* * * * *